US009306336B2

(12) United States Patent
Chang et al.

(10) Patent No.: US 9,306,336 B2
(45) Date of Patent: Apr. 5, 2016

(54) HIGH FREQUENCY CONNECTOR

(71) Applicant: SPEED TECH CORP., Taoyuan (TW)

(72) Inventors: Hua-Chun Chang, Taoyuan (TW); Hsien-Chang Lin, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 14/630,664

(22) Filed: Feb. 25, 2015

(65) Prior Publication Data

US 2015/0311636 A1 Oct. 29, 2015

(30) Foreign Application Priority Data

Apr. 25, 2014 (TW) ..... 103207342 U

(51) Int. Cl.
*H01R 13/648* (2006.01)
*H01R 13/6471* (2011.01)
*H01R 13/6593* (2011.01)
*H01R 24/60* (2011.01)

(52) U.S. Cl.
CPC ..... *H01R 13/6471* (2013.01); *H01R 13/6593* (2013.01); *H01R 24/60* (2013.01)

(58) Field of Classification Search
CPC . H01R 13/6471; H01R 13/6593; H01R 24/60
USPC ..... 439/607.28, 607, 27, 607.29, 660, 439/607.11, 607.34
See application file for complete search history.

(56) References Cited

U.S. PATENT DOCUMENTS

| | | | | |
|---|---|---|---|---|
| 7,758,379 | B2 * | 7/2010 | Chen | H01R 13/6485 439/607.11 |
| 8,109,795 | B2 * | 2/2012 | Lin | H01R 13/6461 439/660 |
| 8,684,769 | B2 * | 4/2014 | Kao | H01R 13/6471 439/607.28 |
| 8,808,029 | B2 * | 8/2014 | Castillo | H01R 13/6585 439/607.05 |
| 8,851,927 | B2 * | 10/2014 | Hsu | H01R 13/6594 439/607.11 |

* cited by examiner

*Primary Examiner* — Abdullah Riyami
*Assistant Examiner* — Harshad Patel
(74) *Attorney, Agent, or Firm* — CKC & Partners Co., Ltd.

(57) ABSTRACT

A high frequency connector includes an insulator, a plurality of terminals, a shielding case and a grounding conductor. The insulator includes a tongue plate portion and a base portion. The terminals respectively have a contact portion arranged on a surface of the tongue plate portion. The contact portion is electrically connected with a docking connector. The shielding case covers outside the tongue plate portion and the base portion. A surface of the base portion is closer to the shielding case than the surface of the tongue plate portion. The grounding conductor is formed to a shielding plate and a first flat plate from a metal sheet. The shielding plate is at least partially fixed within the tongue plate portion. The first flat plate is at least partially exposed from the base portion. The shielding plate and the first flat plate are located in a region covered by the shielding case.

18 Claims, 11 Drawing Sheets

HIGH FREQUENCY CONNECTOR

RELATED APPLICATIONS

This application claims priority to Taiwanese Application Serial Number 103207342, filed Apr. 25, 2014, which is herein incorporated by reference.

BACKGROUND

1. Technical Field

The present disclosure relates to high frequency connectors. More particularly, the present disclosure relates to high frequency connectors suitable for installation in a connector capable of transmitting high frequency electronic signals. The high frequency connector and a cable terminal connector can match with each other. Utilizing the grounding conductor of the high frequency connector, the high frequency electronic noise of the docking connector can be transmitted to the grounding circuit.

2. Description of Related Art

As the volume of the information transmission between many electronic devices is increasing, the speed of signal transmission between many electronic devices must be increased accordingly. In order to allow users to transmit large volumes of electronic information in shorter periods of time, apart from increasing the channels of transmission of electronic signals between the electronic devices, a general measure of increasing the frequency of transmission of the electronic signals between the electronic devices is adopted at present. Connectors are a kind of communication bridge for the electronic signals emitted from various electronic devices. Under the condition that the frequency of the electronic signals transmitted between various electronic devices has been gradually increasing, the adverse effect of high frequency electronic signals when those high frequency electronic signals pass through the high frequency connector should be considered. The reason that has an adverse effect to the transmission of the high frequency electronic signal must be controlled or dealt with by suitable corresponding measures in order to alleviate the substantial effect. Thus, a high frequency electronic signal can be completely transmitted between most of the electronic devices with little or no loss.

Under the trend of the minimization of the size of the electronic devices, the overall volume of the high frequency connector is also required to be minimized. Consequently, under the condition that the quantity of terminals has not decreased or only a small quantity of terminals has been increased, the quantity of terminals in an unit area is thus increased, forming a so-called connector. However, the continuous decrease of space between the conductive terminals is unfavorable due to the transmission of high frequency electronic signals. It is because the high frequency electronic signals transmitted by each of the conductive terminals can easily lead to crosstalk, leading to high frequency electronic signals which were originally transmitted to produce noise.

As shown in FIG. 15, the U.S. Pat. No. 8,684,769 discloses a high frequency connector including an insulator A, a plurality of terminals B, a shielding case C and a grounding conductor D. In the disclosure, the insulator A includes a frame A1, a first insulating unit A2 and a second insulating unit A3. In this prior art, the frame A1 of the insulator A has a through hole A11. The first insulating unit A2 extends a tongue plate portion A22 at a base portion A21. The tongue plate portion A22 of the first insulating unit A2 can penetrate the through hole A11 of the frame A1 of the insulator A, and the second insulating unit A3 is installed at an appropriate location of the first insulating unit A2. Each of the terminals B is distinguished as first group terminals B3 and second group terminals B4. Each of the terminals B has a contact portion B1 and a fixing portion B2, and the contact portion B1 of each of the terminal B of the first group terminals B3 is arranged on an outer surface (an upper surface of the tongue plate portion A22 in the Figs.) of the first insulating unit A2. The second group terminals B4 are fixed on the second insulating unit A3. Then, through the assembly procedure of the two insulating units A2, A3, the contact portion B1 of each of the terminal B of the second group terminals B4 is arranged on an outer surface (an lower surface of the tongue plate portion A22 in the Figs.) of the first insulating unit A2. The fixing portion B2 of each of the terminals B is fixed on a circuit board, such that each of the terminals and the appropriate electric circuit of the circuit board can be electrically connected.

In the disclosure of the prior art, the insulator A is restrained by the shielding case C. By utilizing the characteristics of the shielding of electromagnetic waves by the metallic material of the shielding case C, the terminals B fixed on the insulator A are protected. The effect on signal completeness during the transmission of electronic signals of each of the terminals B by electromagnetic waves outside the high frequency connector is prevented.

In the disclosure of the prior art, since the contact portion B1 of each of the terminals B of the first group terminals B3 and the second group terminals B4 is arranged on the two opposite surfaces of the tongue plate portion A22 of the insulator A, the distance between the contact portion B1 of each of the terminals B of the two group terminals B3, B4 is made too close. This can easily produce a mutual induction of the electromagnetic waves, particularly when a high frequency electronic signal is transmitted. Therefore, the grounding conductor D isolates the electromagnetic waves of the two group terminals B3, B4 causing a mutual induction.

In the disclosure of the prior art, the grounding conductor D has a plurality of cantilevers D1 and a plurality of connecting portions D2. The cantilever D1 of each of the grounding conductor D extends between the contact portion B1 of each of the terminals B of the two group terminals B3, B4, then transmits the noises of electromagnetic waves between the contact portion B1 of each of the terminals B of the two group terminals B3, B4 through the connecting portions D2 of the grounding conductor D to the grounding circuit.

In the disclosure of the prior art, the grounding conductor D forms an interference with the first insulating unit A2 through each of the cantilevers D1. The base portion A21 and the tongue plate portion A22 of the first insulating unit A2 have to be provided with channels (not shown in the Figs.) to accommodate each of the cantilever D1. With this structure, apart from the breaking of the shielding effect of the grounding conductor D, the channels located at the base portion A21 and the tongue plate portion A22 of the first insulating unit A2 are difficult to form, which should be improved.

SUMMARY

A technical aspect of the present disclosure provides a high frequency connector of which the grounding conductor is suitable to be fixed on the tongue plate portion of the insulator by insert molding, such that the breaking of the surface of the grounding conductor is avoided.

According to an embodiment of the present disclosure, a high frequency connector includes an insulator, a plurality of terminals, a shielding case and a grounding conductor. The insulator includes a tongue plate portion and a base portion. The surfaces of the tongue plate portion and the base portion of the insulator are different in height. The terminals respectively have a contact portion. The contact portion of each of the terminals is arranged on a surface of the tongue plate portion of the insulator. The contact portion of each of the terminals is electrically connected with a docking connector. The shielding case substantially covers outside the tongue plate portion and the base portion of the insulator. The grounding conductor is formed to a shielding plate and a first flat plate from a metal sheet through cutting and bending. The shielding plate is fixed within the tongue plate portion of the insulator. A surface of the first flat plate is at least partially exposed from the base portion of the insulator. The shielding plate and the first flat plate of the grounding conductor are located in a region covered by the shielding case.

According to an embodiment of the present disclosure, the insulator includes a frame, a first insulating unit and a second insulating unit. The tongue plate portion of the insulator is disposed on the frame. For the disclosure of the first embodiment and the prior art disclosed in the U.S. Pat. No. 8,684,769, the insulator disclosed in the first embodiment of the present disclosure has the tongue plate portion disposed on the frame, while in the prior art a through hole is formed on the frame and the tongue plate portion is disposed on the first insulating unit. Although there is little difference of the structure of the insulator in the two disclosures, the difference dose not affect the technologies of the two disclosures appropriate to be used in the present disclosure.

According to an embodiment of the present disclosure, each of the grounding conductors is substantially manufactured from a thin metal sheet through a sheet metal forming technique. Each of the grounding conductors has a shielding plate and at least one first flat plate. The shielding plate of each of the grounding conductors is located in the tongue plate portion of the insulator. The first flat plate of each of the grounding conductors is partially exposed outside the base portion of the insulator. Thus, the grounding conductor can be assembled to the insulator, or any part of the insulator is formed on a surface of the grounding conductor through insert molding, without causing the breaking of the shielding effect of the grounding conductor or the difficulty in the forming of the tongue plate portion of the insulator as disclosed in the prior art.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
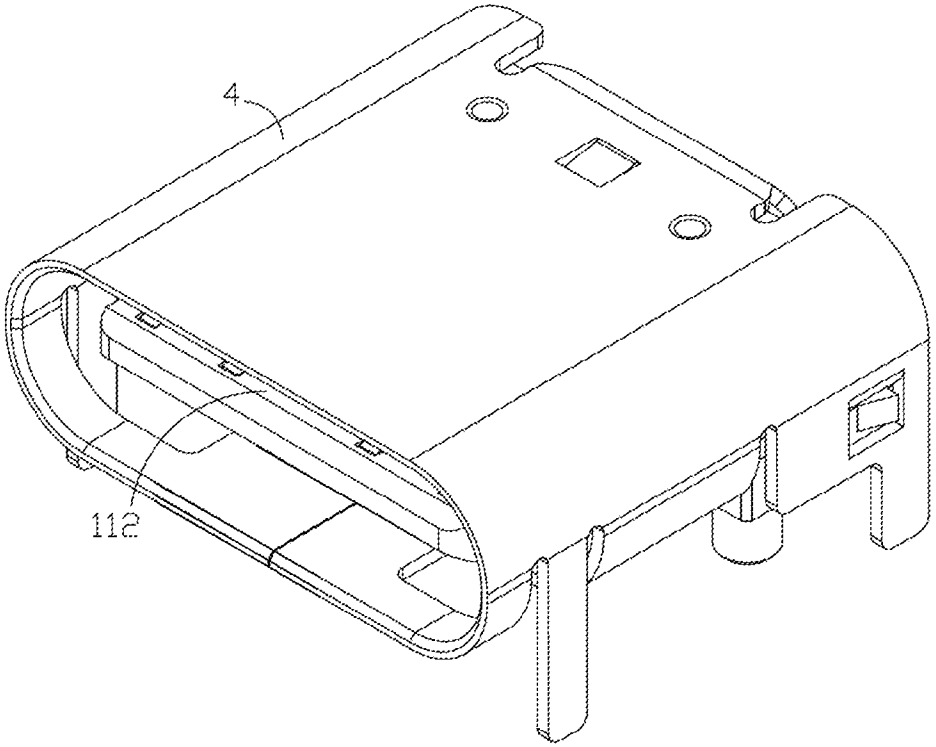
FIG. 1 is a perspective view of a high frequency connector according to the first embodiment of the present disclosure.
Figure 2:
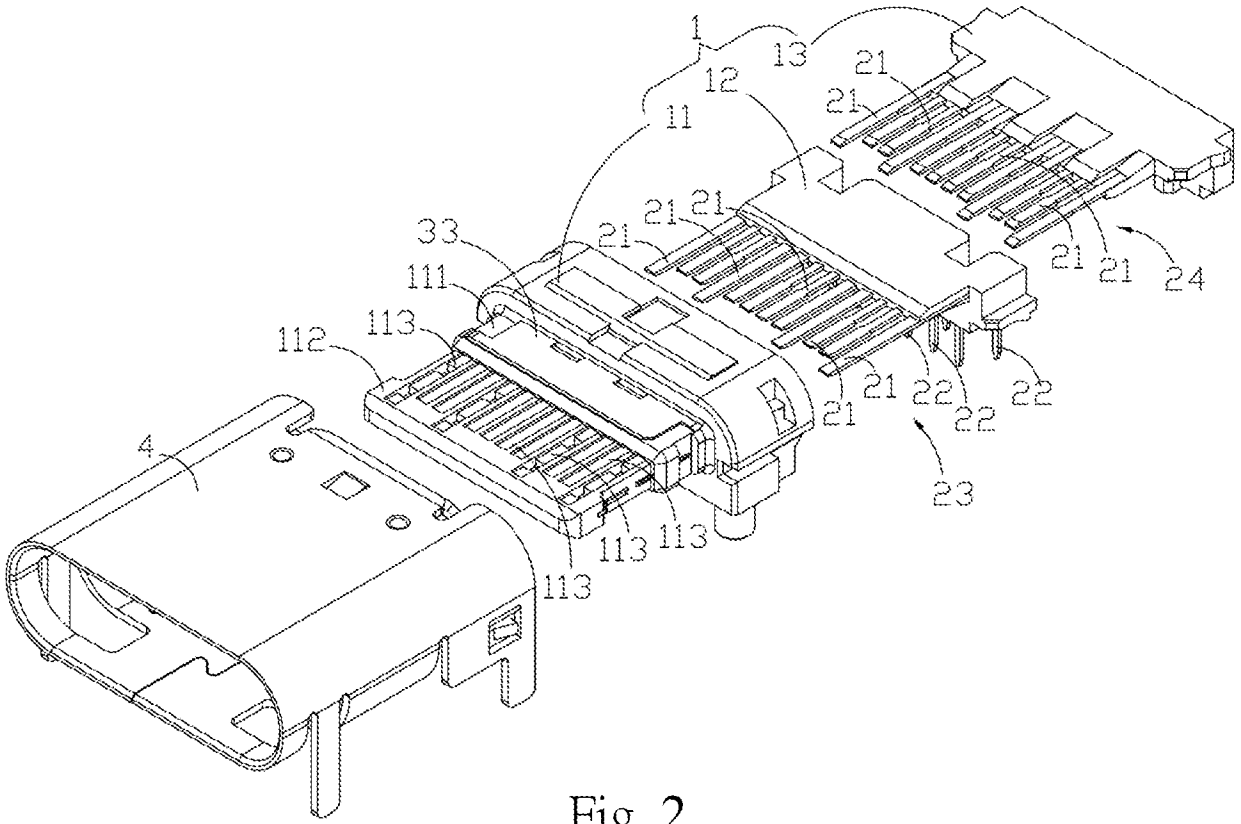
FIG. 2 is an partially exploded view of FIG. 1.
Figure 3:
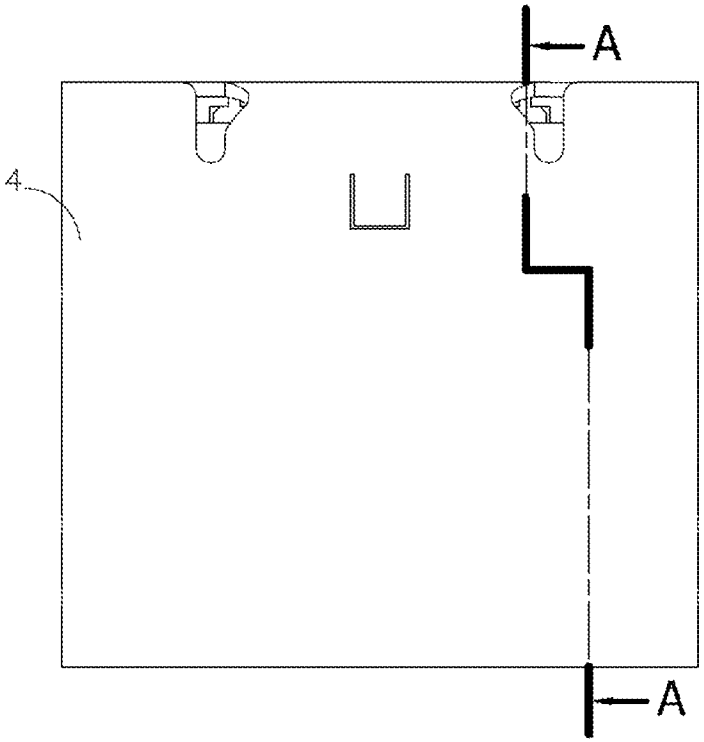
FIG. 3 is a plan view of FIG. 1.

Drawings will be used below to disclose a plurality of embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As shown in FIGS. 1-4, the high frequency connector disclosed in the first embodiment of the present disclosure includes an insulator 1, a plurality of terminals 2, a grounding conductor 3 and a shielding case 4. Each of the terminals 2 is fixed on the insulator 1, and the shielding case 4 is disposed outside the insulator 1. The insulator 1 includes a frame 11, a first insulating unit 12 and a second insulating unit 13. The frame 11 of the insulator 1 extends to form a base portion 111. The base portion 111 of the frame 11 further extends to form a tongue plate portion 112. The two non-adjacent surfaces (the upper surface and the lower surface of the tongue plate portion in the Figs.) of the tongue plate portion 112 have a plurality of accommodation grooves 113. Each of the terminals 2 has a contact portion 21 and a fixing portion 22. The contact portion 21 of each of the terminals 2 is used to electrically connect with a docking connector (not shown in the Figs.). The fixing portion 22 of each of the terminals 2 is used to electrically connect with an appropriate electronic circuit of a circuit board. The terminals 2 are distinguished to first group terminals 23 and second group terminals 24. The first group terminals 23 are fixed on the first insulating unit 12. The second group terminals 24 are fixed on the second insulating unit 13.

In this embodiment, the first insulating unit 12 and the second insulating unit 13 are respectively formed on the edge of the first group terminals 23 and the second group terminals 24. This is because the first insulating unit 12 and the second insulating unit 13 disclosed in the first embodiment in the present disclosure are formed on the edge of the first group terminals 23 and the second group terminals 24 by insert molding. The contact portion 21 and the fixing portion 22 of each of the terminals 2 are respectively conducting materials extended from the first insulating unit 12 and the second insulating unit 13. Therefore, when the first insulating unit 12 and the second insulating unit 13 are assembled to frame 11, the contact portion 21 of each of the terminals 2 of the first group terminals 23 and the second group terminals 24 is at least partially accommodated in the accommodation grooves 113 of the tongue plate portion 112 of the frame 11.

The shielding case 4 is formed from a metal plate cut and bent by a mechanical sheet forming technique. The shielding case 4 substantially covers outside the insulator 1, configured to isolate the electromagnetic waves inside and outside the shielding case 4. When each of the terminals 2 inside the shielding case 4 transmits a high frequency electronic signal, the production of noises as affected by the external electromagnetic waves is avoided.

Figure 5:
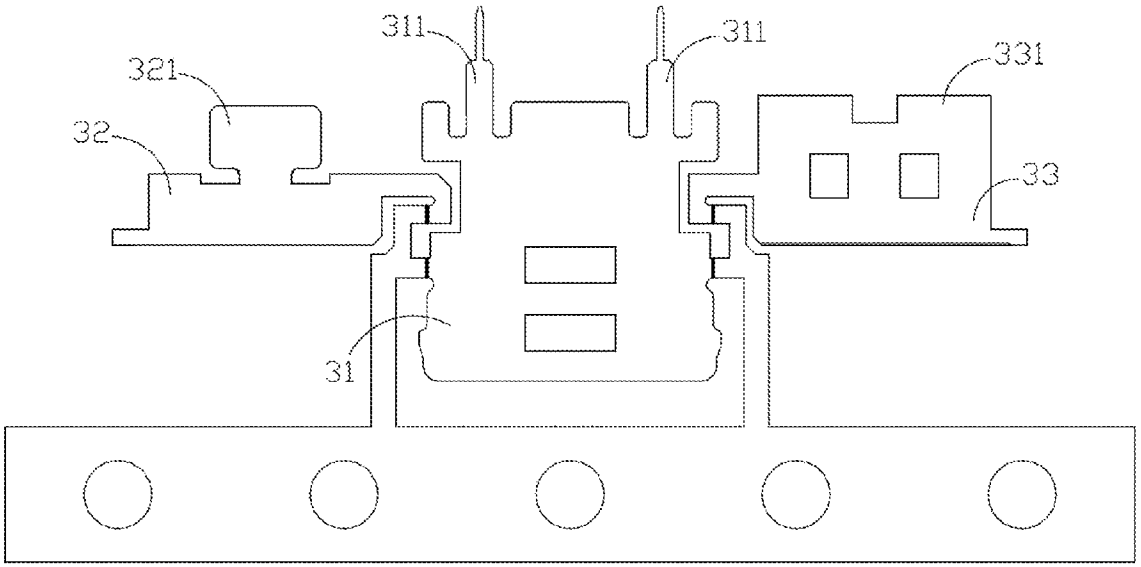
FIG. 5 is an expanded view of the grounding conductor of the first embodiment (with a strip)

The grounding conductor 3 is integrally formed from a thin metal sheet by a sheet forming technique to form a shielding plate 31, a first flat plate 32 and a second flat plate 33. The shielding plate 31 is positioned within the tongue plate portion 112 of the insulator 1. The first flat plate 32 and the second flat plate 33 are respectively flattened on non-adjacent surfaces of the base portion 111 of the frame 11. The integral forming of the grounding conductor 3 to form the shielding plate 31, the first flat plate 32 and the second flat plate 33 refers to the forming of the grounding conductor 3 on the material of the thin metal sheet. After the manufacturing procedure of positioning of the grounding conductor 3 on the insulator 1 is completed, the electrical connection between the shielding plate 31, the first flat plate 32 and the second flat plate 33 can be cut (as shown in FIG. 5). At this point, the function of electromagnetic shielding of the grounding conductor 3 is not affected.

The shielding plate 31 of the grounding conductor 3 is positioned within the base portion 111 and the tongue plate portion 112 of the frame 11, configured to isolate the mutual electromagnetic induction between the contact portions 21 of each of the terminals 2 located on two opposite surfaces of the tongue plate portion 112. In the first embodiment of the present disclosure, the first flat plate 32 and the second flat plate 33 are respectively flattened on non-adjacent surfaces of the base portion 111 of the frame 11, such that the parts of each of the terminals 2 other than the contact portion 21 and the fixing portion 22, can obtain the effect of shielding of electromagnetic waves by the covering of the shielding plate 31, the first flat plate 32 and the second flat plate 33.

In the disclosure of the first embodiment of the present disclosure, the frame 11 of the insulator 1 is directly formed at the edge of the grounding conductor 3 by insert molding. The shielding plate 31, the first flat plate 32 and the second flat plate 33 of the grounding conductor 3 by integral forming can be simultaneously positioned on the two non-adjacent surfaces of the tongue plate portion 112 and the base portion 111 of the frame 11 of the insulator 1. However, this is only illustrative and does not intend to limit the claimed scope. A person having ordinary skill in the art of the present disclosure should treat the change of the grounding conductor 3 as assembled in the change of the frame 11 of the insulator 1.

Figure 4:
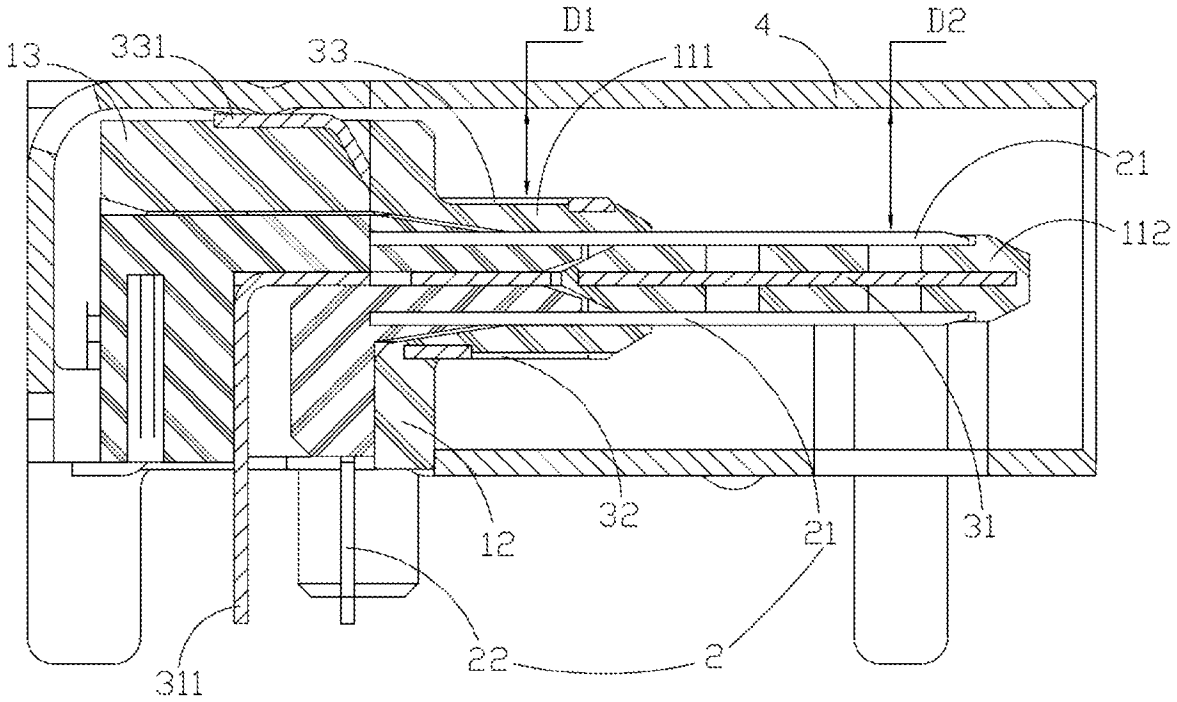
FIG. 4 is an enlarged sectional view of A-A in FIG. 3.

The first flat plate 32 and the second flat plate 33 of the grounding conductor 3 are attached to the outside of the base portion 111 of the frame 11. The base portion 111 and the tongue plate portion 112 of the frame 11 have a section difference, such that the base portion 111 attached with the first flat plate 32 and the second flat plate 33 and the surface of the tongue plate portion 112 configured with a contact portion 21 of the terminal 2 are located on planes of different heights. This means the distance D1 between the first flat plate 32 and the shielding case 4 is different from the distance D2 between the contact portion 21 of any of the terminals 2 on the tongue plate portion 112. In this embodiment, the distance D1 is shorter than the distance D2. As shown in FIG. 4, in order for the shielding plate 31 of the grounding conductor 3 to provide a better shielding protection against the electromagnetic waves for the contact portion 21 of each of the terminals 2 on the tongue plate portion 112 of the frame 11, it is better for the shielding plate 31 of the grounding conductor 3 to extend to transcend the contact portion 21 of the terminals 2 on the tongue plate portion 112. This means the shielding plate 31 of the grounding conductor 3 is closer to a terminal surface of the tongue plate portion 112 of the insulator 1 than the contact portion 21 of any of the terminals 2 on the tongue plate portion 112, or the distance between the end of the shielding plate 31 of the grounding conductor 3 and the base portion 111 of the frame 11 is longer than the distance between the contact portion 21 of any of the terminals 2 and the base portion 111 of the frame 11. The base portion 111 and the tongue plate portion 112 of the frame 11 are located on different planes. Apart from providing a further shielding protection against the electromagnetic waves to each of the terminals 2, the base portion 111 makes the first flat plate 32 and the second flat plate 33 of the grounding conductor 3 closer to the metallic chassis (not shown in the Figs.) of the docking connector. Furthermore, the first flat plate 32 or the second flat plate 33 of the grounding conductor 3 contacts with the metallic chassis of the docking connector, making the high frequency connector and the docking connector form a better shielding space against the electromagnetic waves.

Figure 6:
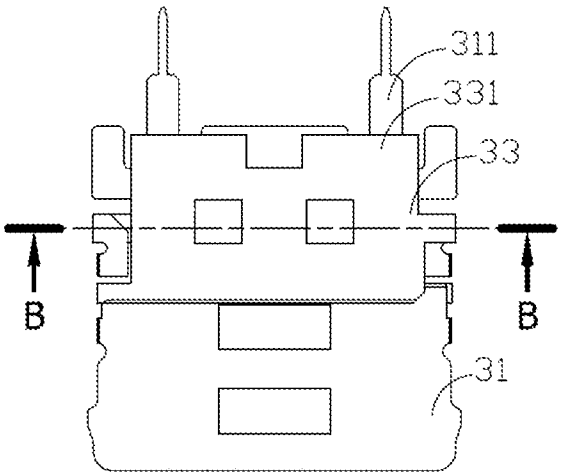
FIG. 6 is a plan view of the grounding conductor of the first embodiment.
Figure 7:
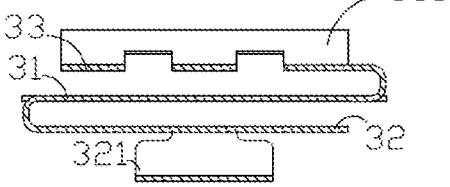
FIG. 7 is a sectional view of B-B of FIG. 6.

As shown in FIGS. 5-8, in the disclosure of the first embodiment of the present disclosure, the grounding conductor 3 is formed from a thin metal plate cut and bent by a mechanical sheet forming technique to form the shielding plate 31, the first flat plate 32, the second flat plate 33 and a plurality of connecting portions 311. Each of the shielding plates 31, the first flat plate 32 and the second flat plate 33 are located on planes of different heights. As shown in FIGS. 6-7, the grounding conductor 3 can be continuous and uninterrupted curves of "S" shape in a section view of the plan view. This is because in the first embodiment, the grounding conductor 3 is formed from a thin metal plate cut and bent by a mechanical sheet forming technique. In FIG. 7, the first flat plate 32 of the grounding conductor 3 has a vertical sheet 321. The vertical sheet 321 of the first flat plate 32 is used to contact with the shielding case 4, such that the shielding case 4 and the grounding conductor 3 have the same electric potential. As shown in FIGS. 4, 6-7, a contact sheet 331 is extended from the second flat plate 33 of the grounding conductor 3. The contact sheet 331 of the second flat plate 33 is exposed outside the insulator 1, such that the contact sheet 331 of the grounding conductor 3 can be used to contact or interfere the shielding case 4, including welding, making the shielding case 4 and the grounding conductor 3 have the same electric potential.

Figure 8:
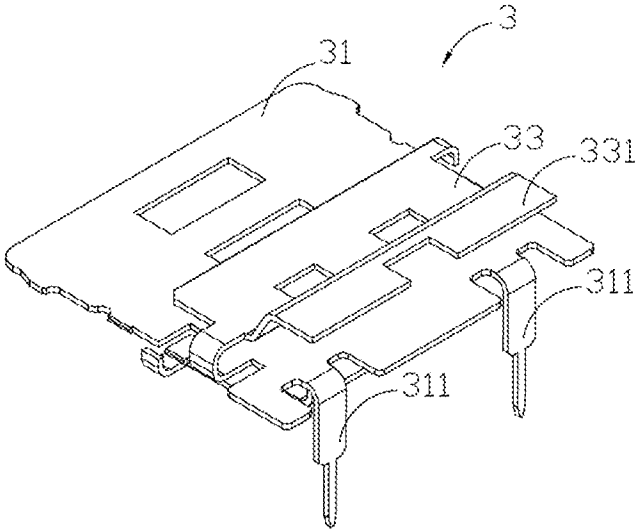
FIG. 8 is a perspective view of the grounding conductor of the first embodiment.

As shown in FIGS. 4-5, 8, as in the first embodiment of the present disclosure, the fixing portion 22 of each of the terminals fixed on the first insulating unit 12 and the second insulating unit 13 has to be electrically connected to the appropriate electric circuit. Thus, after the first insulating unit 12 is assembled to the frame 11, the connecting portion 311 of the grounding conductor 3 is bent towards a grounding circuit, such that the grounding conductor 3 can transmit the high frequency noises of electromagnetic waves to the grounding circuit.

Figure 9:
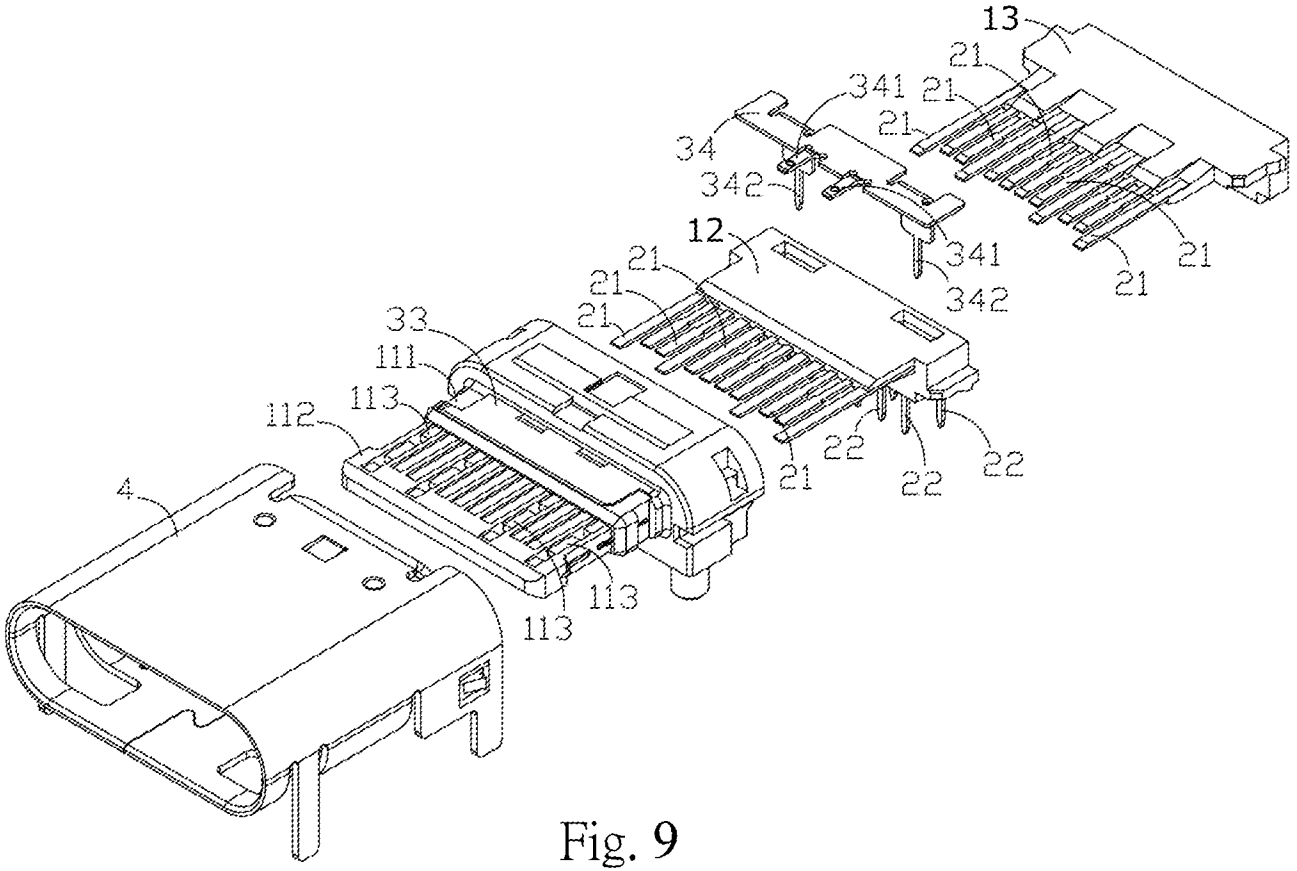
FIG. 9 is a partially exploded view of a high frequency connector according to the second embodiment of the present disclosure.
Figure 11:
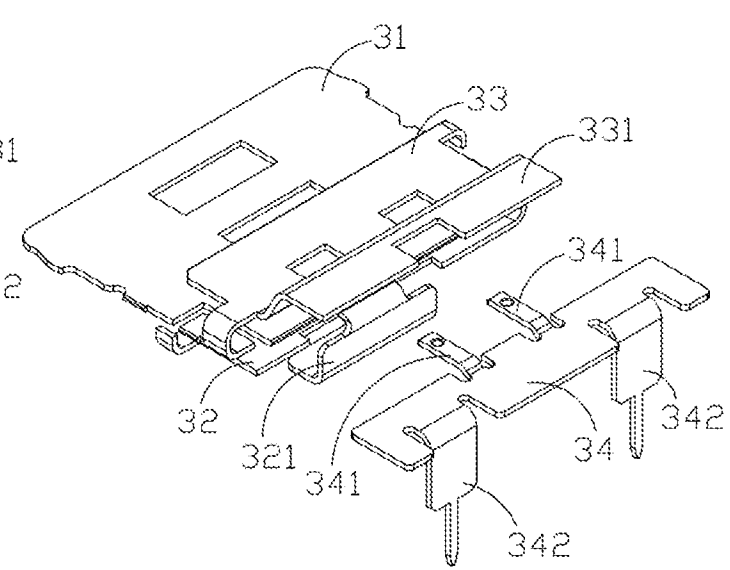
FIG. 11 is an exploded view of FIG. 10.
Figure 10:
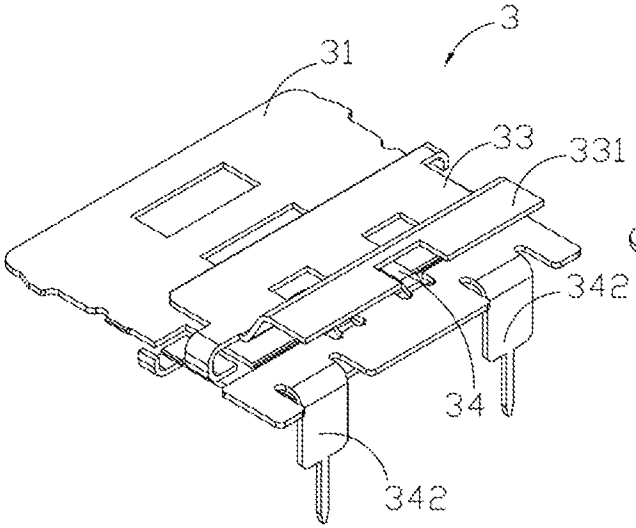
FIG. 10 is a perspective view of the grounding conductor of the second embodiment.

As shown in FIGS. 9-11, in the second embodiment of the present disclosure, the grounding conductor 3 does not electrically connect with the grounding circuit through any connecting portion 311. The grounding conductor 3 is connected with the shielding plate 31 and the grounding circuit through an auxiliary piece 34. The auxiliary piece 34 has a pair of extension arms 341 extending towards a part (the shielding plate in the Figs.) of the grounding conductor 3. The extension arms 341 of the auxiliary piece 34 can mechanically interfere with the grounding conductor 3, i.e., having a frictional force, or being welded to the grounding conductor 3, making the grounding conductor 3 and the auxiliary piece 34 have the same electric potential. Thus, the grounding circuit is electrically connected through the connecting portion 342 of the auxiliary piece 34.

Figure 12:
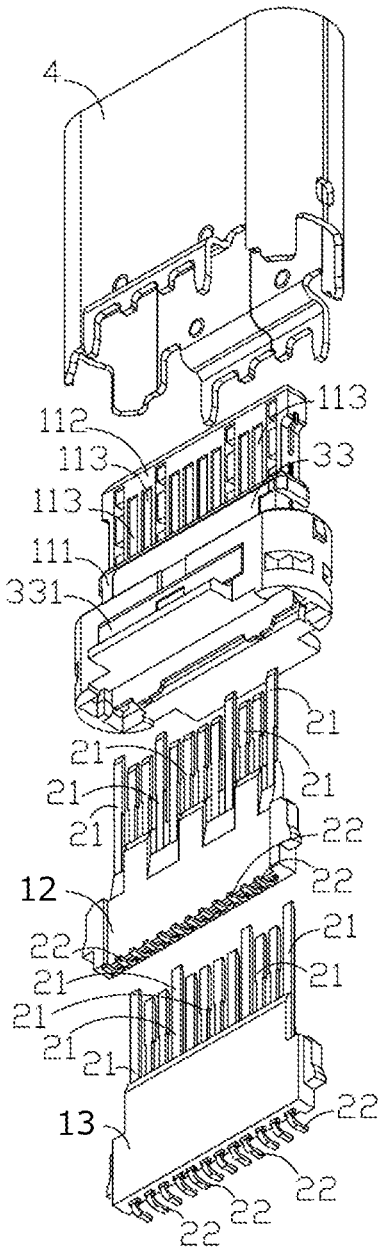
FIG. 12 is a partially exploded view of a high frequency connector according to the third embodiment of the present disclosure.
Figure 14:
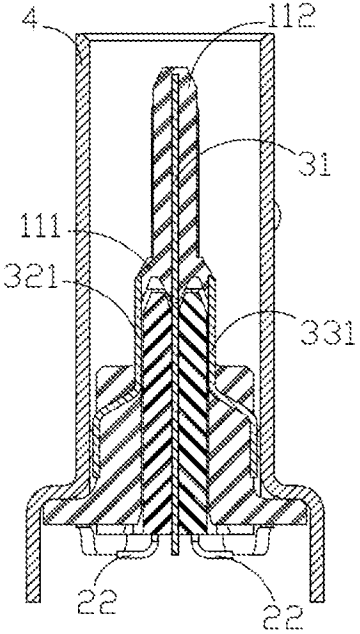
FIG. 14 is a sectional view of D-D of FIG. 13.
Figure 13:
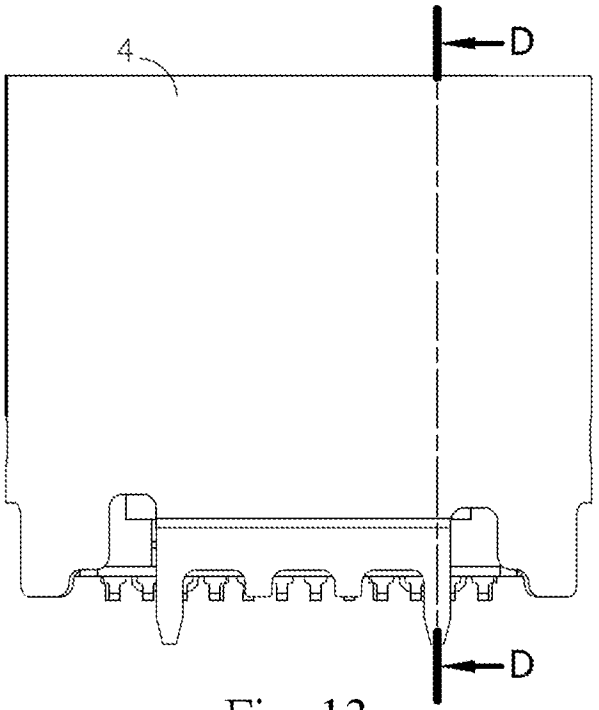
FIG. 13 is a front view of the third embodiment of the present disclosure.
Figure 15:
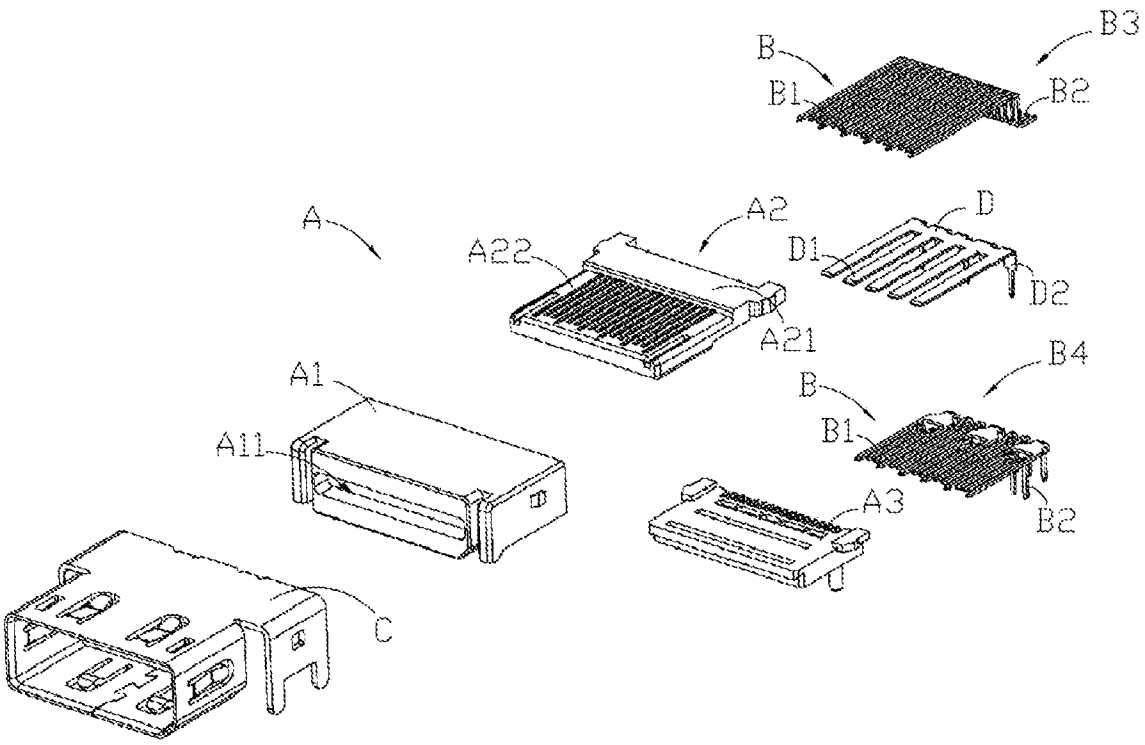
Fig. 15 (Prior Art)
FIG. 15 is the prior art disclosed by the U.S. Pat. No. 8,684,769.

As shown in FIGS. 12-14, the third embodiment of the present disclosure is a connector of top entry. In this third embodiment, the vertical sheet 321 of the first flat plate 32 and the contact sheet 331 of the second flat plate 33 of the grounding conductor 3 have the same appearance and the same function. With the same dimensions of the appearance, the grounding conductor 3 is electrically connected to the shielding case 4. Thus, the first flat plate 32 and the second flat plate 33 of the grounding conductor 3 can be electrically connected with the shielding case 4 using the same means. In addition, in the disclosure of the third embodiment, the grounding conductor 3 does not extend to form any connecting portion to electrically connect with the grounding circuit. Instead, the shielding plate 31 is directly used to electrically connect with the grounding circuit.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A high frequency connector, comprising:

an insulator comprising a tongue plate portion and a base portion;

a plurality of terminals, respectively having a contact portion, the contact portion of each of the terminals is arranged on a surface of the tongue plate portion of the insulator, such that the contact portion of each of the terminals is electrically connected with a docking connector;

a shielding case substantially covering outside the tongue plate portion and the base portion of the insulator, a surface of the base portion of the insulator being closer to the shielding case than the surface of the tongue plate portion; and a grounding conductor formed to a shielding plate and a first flat plate from a metal sheet through cutting and bending, the shielding plate being at least partially fixed within the tongue plate portion of the insulator, the first flat plate being at least partially exposed from the base portion of the insulator, the shielding plate and the first flat plate of the grounding conductor being located in a region covered by the shielding case.

2. The high frequency connector of claim 1, wherein the grounding conductor has a second flat plate, the second flat plate of the grounding conductor, the shielding plate, and the first flat plate are located on different planes of the base portion of the insulator.

3. The high frequency connector of claim 2, wherein a contact sheet is extended from the second flat plate of the grounding conductor and exposed from a surface of a frame of the insulator, such that the contact sheet of the grounding conductor is located between the insulator and the shielding case.

4. The high frequency connector of claim 1, wherein the shielding case is electrically connected to a grounding circuit of a circuit board.

5. The high frequency connector of claim 4, wherein a connecting portion is at least extended from the grounding conductor, and the grounding conductor is electrically connected to the grounding circuit through the connecting portion.

6. The high frequency connector of claim 5, wherein the connecting portion of the grounding conductor is formed by a sheet metal forming technique after the grounding conductor is positioned on the insulator, and the grounding conductor is electrically connected to the grounding circuit through the connecting portion.

7. The high frequency connector of claim 4, wherein the grounding conductor further comprises an auxiliary piece detachably assembled to the grounding conductor, and the auxiliary piece has a connecting portion, and the grounding conductor is electrically connected to the grounding circuit through the connecting portion of the auxiliary piece.

8. The high frequency connector of claim 1, wherein the shielding plate of the grounding conductor is electrically connected to a grounding circuit of a circuit board.

9. The high frequency connector of claim 8, wherein a connecting foot is extended from the shielding plate of the grounding conductor towards the circuit board, and the connecting foot of the grounding conductor is electrically connected to the grounding circuit of the circuit board.

10. The high frequency connector of claim 1, wherein the grounding conductor comprises an auxiliary piece which is detachable, and the auxiliary piece mechanically interferes with the grounding conductor.

11. The high frequency connector of claim 10, wherein a portion of the auxiliary piece of the grounding conductor is welded to the grounding conductor.

12. The high frequency connector of claim 1, wherein the first plate of the ground conductor has a vertical sheet, and the vertical sheet mechanically contacts with the shielding case.

13. The high frequency connector of claim 12, wherein the vertical sheet is welded to the shielding case.

14. The high frequency connector of claim 1, wherein the tongue plate portion of the insulator is extended from a frame, the tongue plate portion of the insulator has a terminal surface located away from the frame, a distance between the terminal surface and an end of the shielding plate of the grounding conductor is shorter than a distance between the terminal surface and any of the contact portions of the terminals.

15. The high frequency connector of claim 1, wherein two opposite surfaces of the tongue plate portion of the insulator are recessed to form a plurality of terminal grooves, and each of the terminal grooves is configured to accommodate one of the contact portions of the terminal.

16. The high frequency connector of claim 15, wherein the terminals of which each of the contact portions is arranged on the same surface of the tongue plate portion are fixed on a same insulating unit, and the insulating unit is substantially accommodated in a frame of the insulator.

17. The high frequency connector of claim 1, wherein the contact portion of each of the terminals is arranged on two opposite surfaces of the tongue plate portion of the insulator, and the base portion of the insulator is higher than the two surfaces of the tongue plate portion.

18. The high frequency connector of claim 17, wherein the grounding conductor has a second flat plate, and the second flat plate of the grounding conductor, the shielding plate, and the first flat plate are located on different planes of the base portion of the insulator.

* * * * *